US009257761B2

(12) United States Patent
Hirakawa

(10) Patent No.: US 9,257,761 B2
(45) Date of Patent: Feb. 9, 2016

(54) ELECTRICAL COAXIAL CONNECTOR

(71) Applicant: DAI-ICHI SEIKO CO., LTD., Kyoto (JP)

(72) Inventor: Takeshi Hirakawa, Tokyo (JP)

(73) Assignee: Dai-ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 14/494,939

(22) Filed: Sep. 24, 2014

(65) Prior Publication Data

US 2015/0104974 A1 Apr. 16, 2015

(30) Foreign Application Priority Data

Oct. 10, 2013 (JP) ..... 2013-212587

(51) Int. Cl.

| | |
|---|---|
| ***H01R 24/50*** | (2011.01) |
| ***H01R 9/05*** | (2006.01) |
| ***H01R 13/652*** | (2006.01) |
| *H01R 103/00* | (2006.01) |

(52) U.S. Cl.

CPC ..... *H01R 9/0512* (2013.01); *H01R 13/652* (2013.01); *H01R 24/50* (2013.01); *H01R 2103/00* (2013.01)

(58) Field of Classification Search

CPC ..... H01R 2103/00; H01R 24/50
See application file for complete search history.

(56) References Cited

U.S. PATENT DOCUMENTS 4,964,805 A * 10/1990 Gabany ..... H01R 24/50 439/434
5,380,211 A * 1/1995 Kawaguchi ..... H01R 4/30 439/581
6,074,217 A * 6/2000 Maruyama ..... H01R 24/40 439/581
7,008,235 B2 * 3/2006 Watanabe ..... H01R 24/50 439/581
7,018,216 B1 * 3/2006 Clark ..... H01R 13/6315 439/487
7,985,076 B2 * 7/2011 Zuinen ..... H01R 24/50 439/63
2004/0102061 A1 * 5/2004 Watanabe ..... H01R 24/50 439/63
2009/0298333 A1 * 12/2009 Yotsutani ..... H01R 12/718 439/581

FOREIGN PATENT DOCUMENTS

| | | | |
|---|---|---|---|
| JP | 2009-104836 | A | 5/2009 |
| JP | 2012-028210 | A | 2/2012 |
| JP | 2013-098122 | A | 5/2013 |
| JP | 2013-118121 | A | 6/2013 |
| WO | 2010/087202 | A1 | 8/2010 |
| WO | 2011/013747 | A1 | 2/2011 |
| WO | 2013/046829 | A1 | 4/2013 |

* cited by examiner

*Primary Examiner* — Gary Paumen
(74) *Attorney, Agent, or Firm* — Studebaker & Brackett PC

(57) ABSTRACT

An electrical coaxial connector comprising a signal-joining contacting conductor and a grounding contacting conductor each supported by an insulating base member, wherein a body portion of the signal-joining contacting conductor has a press-contacting part with a contacting protrusion for contacting with a signal-joining conductor in a mating connector and a first base part in such a manner that a measure of thickness of the press-contacting part including the contacting protrusion is not more than the maximum measure of thickness of the first base part, and an annular portion of the grounding contacting conductor has an engaging part with an engaging protrusion for engaging with a grounding conductor in the mating connector and a second base part in such a manner that a measure of thickness of the engaging part including the engaging protrusion is not more than to the maximum measure of thickness of the second base part.

7 Claims, 9 Drawing Sheets

ELECTRICAL COAXIAL CONNECTOR

BACKGROUND OF THE INVENTION

1. Field of the Invention

The present invention relates generally to an electrical coaxial connector, and more particularly to an improvement in an electrical coaxial connector to be mounted on a circuit board for transmitting signals from the circuit board to the outside thereof or to the circuit board from the outside thereof under a condition of electro-magnetic shield.

2. Description of the Prior Art Including Information Disclosed Under 37 CFR 1.97 and 37 CFR 1.98

A high-frequency signal flowing through conductors arranged on a circuit board is mostly dealt with as a signal which requires to be put in a condition of electro-magnetic shield so as to be inactive to leak out from the conductors or to prevent noises from mixing into the signal from the outside when the high-frequency signal is transmitted from the circuit board to the outside thereof or to the circuit board from the outside thereof. For transmitting the high-frequency signal from a specific circuit board to the outside thereof, for example, to another circuit board, or to the specific circuit board from the outside thereof, for example, from another circuit board, under the condition of electro-magnetic shield, an electrical coaxial connector provided to be mounted on the specific circuit board is used.

The electrical coaxial connector thus provided to be mounted on a circuit board comprises usually an insulating base, a signal-joining contacting conductor provided on the insulating base for transferring a signal and a grounding contacting conductor provided on the insulating base for surrounding the signal-joining contacting conductor to be supplied with a ground potential so as to put the signal supplied to the signal-joining contacting conductor in a condition of electro-magnetic shield. In the electrical coaxial connector mounted on the circuit board, the signal-joining contacting conductor is connected with a signal terminal provided on the circuit board and the grounding contacting conductor is connected with a ground-potential terminal provided on the circuit board. When the electrical coaxial connector mounted on the circuit board is put to practical use, the electrical coaxial connector is coupled with a mating coaxial connector which is, for example, another electrical coaxial connector mounted on another circuit board, so that the signal-joining contacting conductor comes into contact with a signal-joining conductor provided in the mating coaxial connector and the grounding contacting conductor comes into contact with a grounding conductor provided in the mating coaxial connector. With the electrical coaxial connector and the mating coaxial connector coupled with each other in such a manner, the signal supplied to the signal-joining contacting conductor in the electrical coaxial connector or to the signal-joining conductor in the mating coaxial connector is transferred to the signal-joining conductor in the mating coaxial connector or to signal-joining contacting conductor in the electrical coaxial connector under the condition of electro-magnetic shield brought about by the grounding contacting conductor in the electrical coaxial connector and the grounding conductor in the mating coaxial connector. Thereby, the signal is transmitted between the circuit boards, on which the electrical coaxial connector and the mating coaxial connector are mounted respectively, under the condition of electro-magnetic shield.

Such an electrical coaxial connector as mentioned above is usually required to be miniaturized to have a reduced measure of thickness in a direction perpendicular to a parts-mountable surface of the circuit board under a condition wherein an electronic apparatus or the like having the circuit board built-in is put in miniaturization and weight saving, and in addition, is desired to reduce assembling time and labor with improved accuracy in assembly so that manufacturing cost is reduced. Further, under a situation wherein the above requirement and desire are filled, when the electrical coaxial connector is coupled with the mating coaxial connector, a condition wherein the signal-joining contacting conductor connected with the signal terminal provided on the circuit board and the ground-connecting contacting conductor connected with the ground-potential terminal provided on the circuit board are properly and surely connected respectively with the signal-joining conductor in the mating coaxial connector and the grounding conductor in the mating coaxial connector, is desired to be stably maintained for a relatively long period of time.

There has been proposed to provide an improved electrical coaxial connector which comprises an isolating base, a signal-joining contacting conductor provided on the insulating base and a grounding contacting conductor provided on the insulating base to surround the signal-joining contacting conductor to be mounted on a circuit board and with which a certain degree of miniaturization to have a reduced measure of thickness of the electrical coaxial connector on the circuit board is realized and it is intended to reduce assembling time and labor and to improve accuracy in assembly so that manufacturing cost is reduced, as disclosed in, for example, the Japanese patent application published before examination under publication number 2009-104836.

The previously proposed electrical coaxial connector (a plug connector (21)) disclosed in the publication mentioned above comprises a signal-joining contacting conductor (a socket type central conductor (22)) provided to be electrically connected with a signal-joining conductor (a pin type central conductor (12)) of a mating coaxial connector (a receptacle connector (11)), an insulating base (a second insulating housing (24)) mounted on a circuit board (a second board (2)) for supporting at its central portion the signal-joining contacting conductor, and a grounding contacting conductor (a second cylindrical outer conductor (23)) formed into a cylindrical shape for surrounding the insulating base supporting the signal-joining contacting conductor on the circuit board. The signal-joining contacting conductor has a top end portion made of a metallic tube and the signal-joining conductor in the mating coaxial connector is inserted into the top end portion of the signal-joining contacting conductor when the signal-joining contacting conductor is connected with the signal-joining conductor in the mating coaxial connector.

In the previously proposed electrical coaxial connector disclosed in the publication mentioned above, any structure impeding miniaturization to have a reduced measure of thickness of the electrical coaxial connector on the circuit board is not perceived. The manufacturing process of the previously proposed electrical coaxial connector includes a first step of producing by means of insert molding the insulating base supporting the signal-joining contacting conductor to be incorporated therewith and a second step of causing the insulating base and the signal-joining contacting conductor incorporated with the insulating base to engage with the inside of the grounding contacting conductor formed into the cylindrical shape so as to be attached thereto. That is, when the previously proposed electrical coaxial connector disclosed in the publication mentioned above, in which the signal-joining contacting conductor and the grounding contacting conductor surrounding the signal-joining contacting conductor are supported by the insulating base, is manufactured, first, the insulating base is produced for supporting the signal-joining contacting conductor to be incorporated with the insulating base by means of the insert molding, and then, the insulating base and the signal-joining contacting conductor incorporated with the insulating base is attached to the inside of the grounding contacting conductor formed into the cylindrical shape.

In such a case, since the signal-joining contacting conductor is incorporated with the insulating base by means of the insert molding in order to obtain the insulating base caused to support the signal-joining contacting conductor, it is expected in production of the insulating base caused to support the signal-joining contacting conductor that assembling time and labor are reduced and accuracy in assembly is improved so that production cost of the insulating base caused to support the signal-joining contacting conductor is reduced. However, since the insulating base and the signal-joining contacting conductor incorporated with the insulating base are attached to the inside of the grounding contacting conductor formed into the cylindrical shape in order to obtain the insulating base caused to support the grounding contacting conductor, it cannot be expected in production of the insulating base caused to support the grounding contacting conductor that assembling time and labor are reduced and accuracy in assembly is improved so that production cost of the insulating base caused to support the grounding contacting conductor is reduced.

In the previously proposed electrical coaxial connector as described above, which is manufactured through the manufacturing process wherein first the signal-joining contacting conductor is incorporated with the insulating base by means of the insert molding and then the insulating base and the signal-joining contacting conductor incorporated with the insulating base are attached to the inside of the grounding contacting conductor formed into the cylindrical shape, since the signal-joining contacting conductor is incorporated with the insulating base by means of the insert molding, the signal-joining contacting conductor is not provided thereon with any projection forming a contact point for coming into contact with the signal-joining conductor in the mating coaxial connector and the signal-joining conductor in the mating coaxial connector is inserted into the top end portion made of the metallic tube of the signal-joining contacting conductor when the signal-joining contacting conductor is connected with the signal-joining conductor in the mating coaxial connector.

With the previously proposed electrical coaxial connector in which the signal-joining contacting conductor without the projection forming the contact point is employed to be connected with the signal-joining conductor in the mating coaxial connector, it is feared that a condition wherein the signal-joining contacting conductor is properly connected with the signal-joining conductor in the mating coaxial connector is not able to be stably maintained when the previously proposed electrical coaxial connector is coupled with the mating coaxial connector.

The reason why the signal-joining contacting conductor of the previously proposed electrical coaxial connector is not provided thereon with any projection forming the contact point for coming into contact with the signal-joining conductor in the mating coaxial connector is that, if a projection forming the contact point is provided on the signal-joining contacting conductor, the insulating base with which the signal-joining contacting conductor has been incorporated by means of the insert molding is obstructed to be removed from a mold used for the insert molding by the projection on the signal-joining contacting conductor and therefore it comes to be quite difficult to cause the signal-joining contacting conductor to be incorporated with the insulating base by means of the insert molding or the mold to be used for the insert molding comes to be quite complicated in its shape and structure.

Further, with the previously proposed electrical coaxial connector as disclosed above, since the insulating base caused to support the grounding contacting conductor is obtained by means of attaching the insulating base and the signal-joining contacting conductor incorporated with the insulating base to the inside of the grounding contacting conductor formed into the cylindrical shape, the assembling time and labor are not reduced and the accuracy in assembly is not improved in the production of the insulating base caused to support the grounding contacting conductor so that the production cost of the insulating base caused to support the grounding contacting conductor is not reduced. Accordingly, as for the previously proposed electrical coaxial connector on the whole, assembling time and labor are not reduced and accuracy in assembly is not improved in manufacturing of the electrical coaxial connector so that manufacturing cost of the electrical coaxial connector is not reduced.

BRIEF SUMMARY OF THE INVENTION

Accordingly, it is an object of the present invention to provide an electrical coaxial connector comprising a signal-joining contacting conductor provided to be electrically connected with a signal-joining conductor of a mating coaxial connector, a grounding contacting conductor provided to be electrically connected with a grounding conductor in the mating coaxial connector and having a portion thereof placed around the signal-joining contacting conductor, and an insulating base member for supporting the signal-joining contacting conductor and the grounding contacting conductor to be isolated from each other, and which avoids the aforementioned disadvantages encountered with the prior art.

Another object of the present invention is to provide an electrical coaxial connector comprising a signal-joining contacting conductor provided to be electrically connected with a signal-joining conductor of a mating coaxial connector, a grounding contacting conductor provided to be electrically connected with a grounding conductor in the mating coaxial connector and having a portion thereof placed around the signal-joining contacting conductor, and an insulating base member for supporting the signal-joining contacting conductor and the grounding contacting conductor to be isolated from each other, and in which the signal-joining contacting conductor and the grounding contacting conductor are able to be incorporated with the insulating base member by means of insert molding with a simplified mold structure.

A further object of the present invention is to provide an electrical coaxial connector comprising a signal-joining contacting conductor provided to be electrically connected with a signal-joining conductor of a mating coaxial connector, a grounding contacting conductor provided to be electrically connected with a grounding conductor in the mating coaxial connector and having a portion thereof placed around the signal-joining contacting conductor, and an insulating base member for supporting the signal-joining contacting conductor and the grounding contacting conductor to be isolated from each other, and with which assembling time and labor are able to be reduced and accuracy in assembly is able to be improved in manufacturing of the electrical coaxial connector so that manufacturing cost of the electrical coaxial connector is able to be effectively reduced.

According to the present invention, there is provided an electrical coaxial connector, which comprises a signal-joining contacting conductor having a body portion provided to be electrically connected with a signal-joining conductor in a mating coaxial connector and a signal-joining terminal portion extending from the body portion, a grounding contacting conductor having an annular portion placed around the body portion of the signal-joining contacting conductor to be electrically connected with a grounding conductor in the mating coaxial connector and a grounding terminal portion extending from the annular portion, and an insulating base member in which each of the signal-joining terminal portion of the signal-joining contacting conductor and the grounding terminal portion of the grounding contacting conductor is partially buried and which supports the signal-joining contacting conductor and the grounding contacting conductor to be isolated from each other, wherein the body portion of the signal-joining contacting conductor has a press-contacting part provided thereon with a contacting protrusion for coming into press-contact with the signal-joining conductor in the mating coaxial connector and a first base part extending from the press-contacting part to be buried in the insulating base member in such a manner that a measure of thickness of the press-contacting part including the contacting protrusion is less than or equal to the maximum measure of thickness of the first base part, and the annular portion of the grounding contacting conductor has an engaging part provided thereon with an engaging protrusion for coming into engagement with the grounding conductor in the mating coaxial connector and a second base part extending from the engaging part to be buried in the insulating base member in such a manner that a measure of thickness of the engaging part including the engaging protrusion is less than or equal to the maximum measure of thickness of the second base part.

In an embodiment of electrical coaxial connector according to the present invention, the body portion of the signal-joining contacting conductor is formed into a cylindrical shape so that the contacting protrusion provided on the press-contacting part of the body portion formed into the cylindrical shape projects to the inside of the body portion, and the engaging protrusion provided on the engaging part of the annular portion of the grounding contacting conductor projects to the inside of the annular portion.

Further, the first base part of the body portion and a part of the signal-joining terminal portion of the signal-joining contacting conductor and the second base part of the annular portion and a part of the grounding terminal portion of the grounding contacting conductor are incorporated with the insulating base member by means of insert molding.

When the electrical coaxial connector thus constituted in accordance with the present invention is put to practical use, for example, the insulating base member is mounted on a circuit board so that the signal-joining terminal portion of the signal-joining contacting conductor is connected with a signal terminal provided on the circuit board and the grounding terminal portion of the grounding contacting conductor is connected with a grounding terminal provided on the circuit board. Then, the body portion of the signal-joining contacting conductor having the signal-joining terminal portion connected with the signal terminal provided on the circuit board is electrically connected with the signal-joining conductor in the mating coaxial connector and the annular portion of the grounding contacting conductor having the grounding terminal portion connected with the grounding terminal provided on the circuit board is electrically connected with the grounding conductor in the mating coaxial connector.

The body portion of the signal-joining contacting conductor has the press-contacting part provided thereon with the contacting protrusion for coming into contact with the signal-joining conductor in the mating coaxial connector and the first base part extending from the press-contacting part to be buried in the insulating base member, wherein the measure of thickness of the press-contacting part including the contacting protrusion is less than or equal to the maximum measure of thickness of the first base part. The annular portion of the grounding contacting conductor has the engaging part provided thereon with the engaging protrusion for coming into engagement with the grounding conductor in the mating coaxial connector and the second base part extending from the engaging part to be buried in the insulating base member, wherein the measure of thickness of the engaging part including the engaging protrusion is less than or equal to the maximum measure of thickness of the second base part.

Under such a condition, for example, the body portion of the signal-joining contacting conductor is formed into the cylindrical shape so that the contacting protrusion provided on the press-contacting part of the body portion projects to the inside of the body portion and the engaging protrusion provided on the engaging part of the annular portion of the grounding contacting conductor projects to the inside of the annular portion.

Further, for example, the first base part of the body portion and the part of the signal-joining terminal portion of the signal-joining contacting conductor and the second base part of the annular portion and the part of the grounding terminal portion of the grounding contacting conductor are incorporated with the insulating base member by means of insert molding.

In the electrical coaxial connector according to the present invention, the body portion of the signal-joining contacting conductor which is electrically connected with the signal-joining conductor in the mating coaxial connector when the electrical coaxial connector is coupled with the mating coaxial connector, has the press-contacting part provided thereon with the contacting protrusion for coming into contact with the signal-joining conductor in the mating coaxial connector and the first base part extending from the press-contacting part to be buried in the insulating base member, wherein the measure of thickness of the press-contacting part including the contacting protrusion is less than or equal to the maximum measure of thickness of the first base part, and the annular portion of the grounding contacting conductor which is electrically connected with the grounding conductor in the mating coaxial connector when the electrical coaxial connector is coupled with the mating coaxial connector, has the engaging part provided thereon the engaging protrusion for coming into engagement with the grounding conductor in the mating coaxial connector and the second base part extending from the engaging part to be buried in the insulating base member, wherein the measure of thickness of the engaging part including the engaging protrusion is less than or equal to the maximum measure of thickness of the second base part.

With the body portion of the signal-joining contacting conductor in which the measure of thickness of the press-contacting part including the contacting protrusion is determined to be less than or equal to the maximum measure of thickness of the first base part and the annular portion of the ground contacting conductor in which the measure of thickness of the engaging part including the engaging protrusion is determined to be less than or equal to the maximum measure of thickness of the second base part, the insert molding for incorporating the signal-joining contacting conductor and the grounding contacting conductor with the insulating base member operative to support the signal-joining contacting conductor and the grounding contacting conductor to be isolated from each other is able to be carried out with a simplified mold structure without bringing about a situation wherein the insulating base member with which the signal-joining contacting conductor and the grounding contacting conductor have been incorporated is obstructed to be removed from the mold structure after the insert molding. By means of such an insert molding, for example, the first base part of the body portion and the part of the signal-joining terminal portion of the signal-joining contacting conductor and the second base part of the annular portion and the part of the grounding terminal portion of the grounding contacting conductor are incorporated with the insulating base member.

Accordingly, with the electrical coaxial connector according to the present invention, the signal-joining contacting conductor and the grounding contacting conductor are able to be incorporated with the insulating base member by means of the insert molding with the simplified mold structure and thereby assembling time and labor are able to be reduced and accuracy in assembly is able to be improved in manufacturing of the electrical coaxial connector, so that manufacturing cost of the electrical coaxial connector is able to be effectively reduced.

Further, in the embodiment of electrical coaxial connector according to the present invention, under a condition wherein the body portion of the signal-joining contacting conductor is formed into the cylindrical shape so that the contacting protrusion provided on the press-contacting part of the body portion projects to the inside of the body portion and the engaging protrusion provided on the engaging part of the annular portion of the grounding contacting conductor projects to the inside of the annular portion, when the signal-joining conductor in the mating coaxial connector is inserted into the body portion of the signal-joining contacting conductor, the contacting protrusion provided on the press-contacting part of the body portion comes into contact with the signal-joining conductor in the mating coaxial connector so that the body portion of the signal-joining contacting conductor is electrically connected with the signal-joining conductor in the mating coaxial connector, and when the grounding conductor in the mating coaxial connector is inserted into the annular portion of the grounding contacting conductor, the engaging protrusion provided on the engaging part of the annular portion comes into engagement with the grounding conductor in the mating coaxial connector so that the annular portion of the grounding contacting conductor is electrically connected with the grounding conductor in the mating coaxial connector. Consequently, a condition wherein the body portion of the signal-joining contacting conductor is properly connected with the signal-joining conductor in the mating coaxial connector and the annular portion of the grounding contacting conductor is properly connected with the grounding conductor in the mating coaxial connector is stably maintained.

The above, and other objects, features and advantages of the present invention will become apparent from the following detailed description taken in conjunction with the accompanying drawings.

BRIEF DESCRIPTION OF THE SEVERAL VIEWS OF DRAWINGS

DETAILED DESCRIPTION OF THE INVENTION

Figure 1:
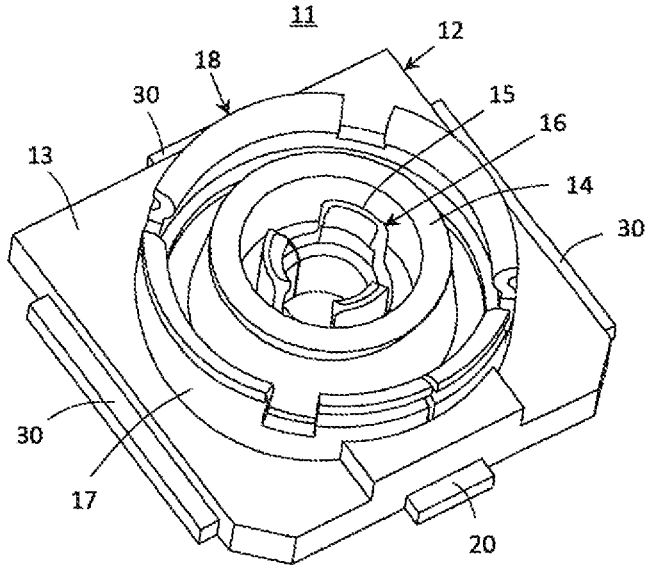
FIG. 1 is a schematic perspective view showing an embodiment of electrical coaxial connector according to the present invention.
Figure 2:
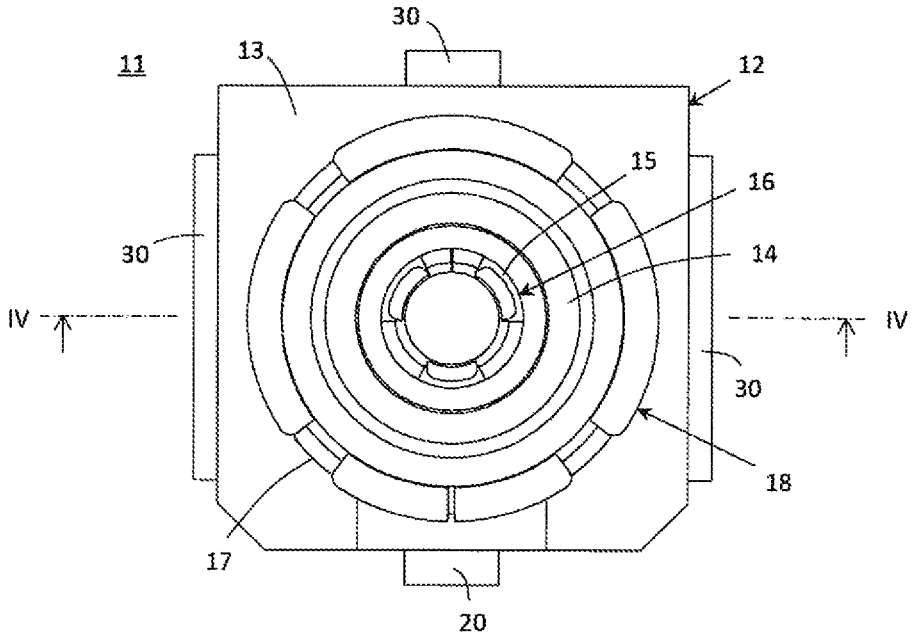
FIG. 2 is a schematic plan view showing the embodiment of electrical coaxial connector according to the present invention.
Figure 3:
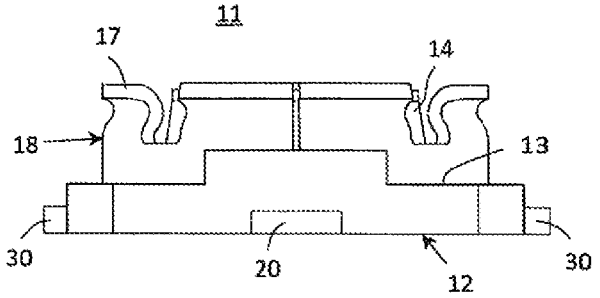
FIG. 3 is a schematic front view showing the embodiment of electrical coaxial connector according to the present invention.

FIGS. 1, 2 and 3 show an embodiment of electrical coaxial connector according to the present invention.

Figure 4:
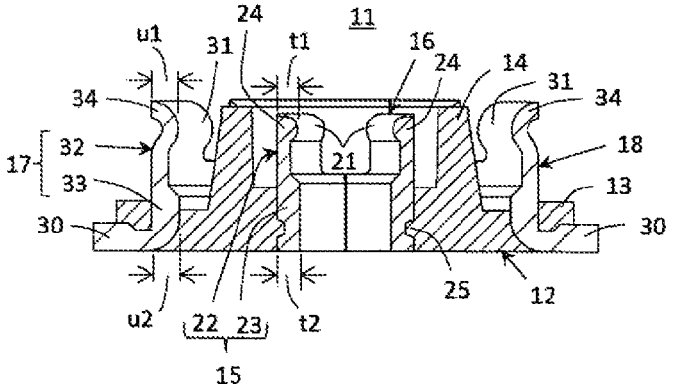
FIG. 4 is a schematic cross-sectional view showing a cross section taken along line IV-IV in FIG. 2.

Referring to FIGS. 1 to 3, an electrical coaxial connector 11, which constitutes the embodiment of electrical coaxial connector according to the present invention, is provided to be mounted on a circuit board and coupled with a mating coaxial connector as another electrical coaxial connector for practical use. The electrical coaxial connector 11 has an insulating base member 12 made of insulator such as plastics or the like to be put on the circuit board on which the electrical coaxial connector 11 is mounted. The insulating base member 12 is provided with a flat board portion 13 and an annular projection 14 formed into a cylindrical shape at a central part of the flat board portion 13, as shown also in FIG. 4 showing a cross-section taken along line IV-IV in FIG. 2.

The electrical coaxial connector 11 comprises, in addition to the insulating base member 12, a signal-joining contacting conductor 16 which has a body portion 15 provided at the inside of the annular projection 14 of the insulating base member 12 to be electrically connected with a signal-joining conductor in the mating coaxial connector and a grounding contacting conductor 18 which has an annular portion 17 provided around the annular projection 14 of the insulating base member 12 surrounding the body portion 15 of the signal-joining contacting conductor 16 to be electrically connected with a grounding conductor in the mating coaxial connector. The signal-joining contacting conductor 16 and the grounding contacting conductor 18 are supported by the insulating base member 12 to be isolated from each other.

Figure 5:
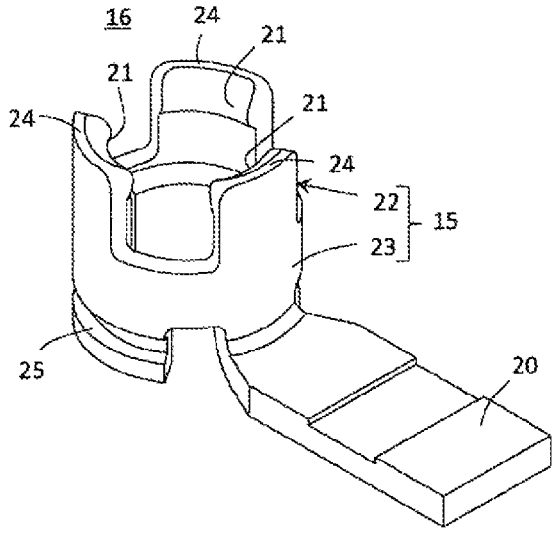
FIG. 5 is a schematic top and rear perspective view showing a signal-joining contacting conductor provided to be employed in the embodiment of electrical coaxial connector according to the present invention.
Figure 6:
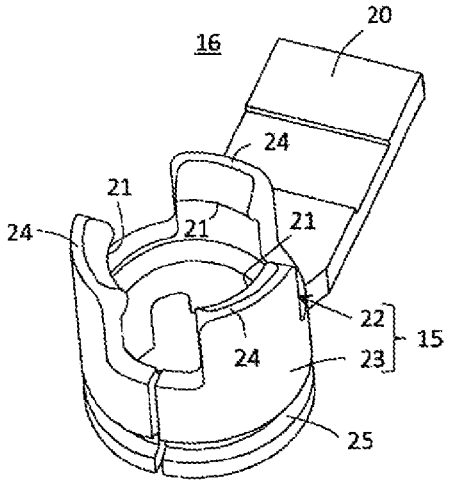
FIG. 6 is a schematic top and front perspective view showing the signal-joining contacting conductor provided to be employed in the embodiment of electrical coaxial connector according to the present invention.
Figure 7:
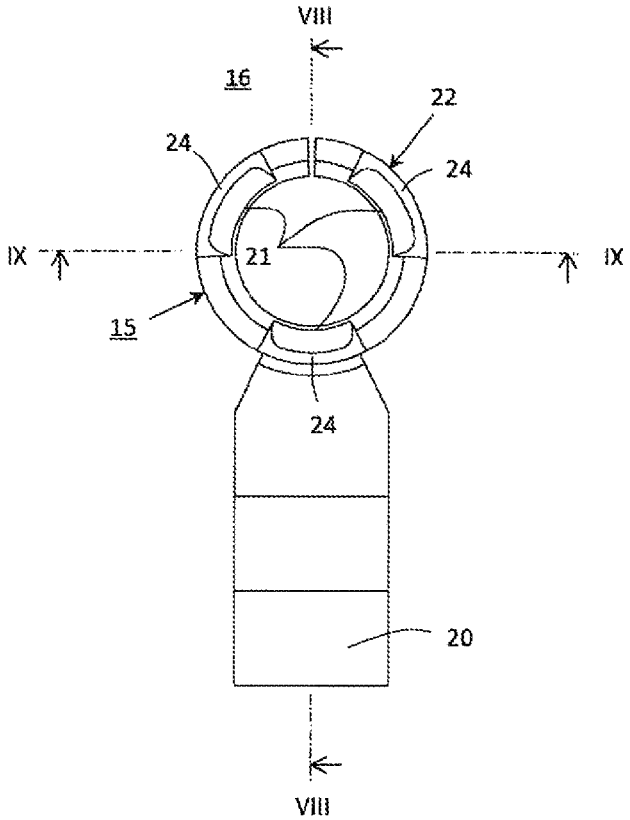
FIG. 7 is a schematic plan view showing the signal-joining contacting conductor provided to be employed in the embodiment of electrical coaxial connector according to the present invention.

The signal-joining contacting conductor 16 is made of, for example, resilient conductive material such as a metal plate to have, in addition to the body portion 15, a signal-joining terminal portion 20 extending from an end of the body portion 15, as shown in FIGS. 5 to 7. The body portion 15 of the signal-joining contacting conductor 16 is formed into a cylindrical shape to have a press-contacting part 22 provided thereon a contacting protrusion 21 for coming into contact with the signal-joining conductor in the mating coaxial connector and a base part 23 extending from the press-contacting part 22 to be buried in the flat board portion 13 of the insulating base member 12.

The press-contacting part 22 of the body portion 15 comprises a plurality of, for example, three resilient contacting curved plates 24 arranged to surround an imaginary central axis of the cylindrical shape of the body portion 15 with a space between each two adjoin each other. Each of the resilient contacting curved plates 24 is provided thereon the contacting protrusion 21 projecting to the inside of the body portion 15 formed into the cylindrical shape.

Figure 8:
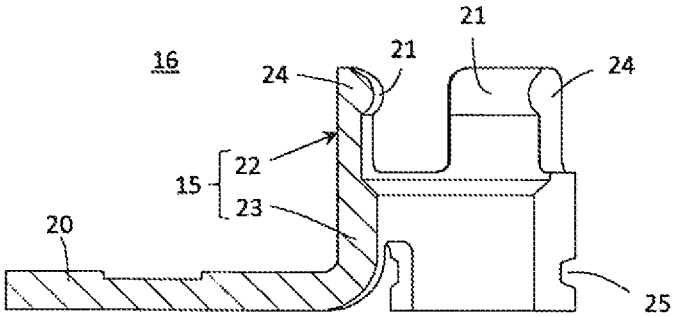
FIG. 8 is a schematic cross-sectional view showing a cross section taken along line VIII-VIII in FIG. 7.

The base part 23 of the body portion 15 is provided thereon with a groove 25 extending along a direction surrounding the imaginary central axis of the cylindrical shape of the body portion 15. As shown in FIG. 4, a part of the insulating base member 12 is inserted in the groove 25 provided on the base part 23 of the body portion 15. Further, the base part 23 of the body portion 15 includes an end of the body portion 15 from which the signal-joining terminal portion 20 extends. Therefore, as shown clearly in FIG. 8 showing a cross section taken along line VIII-VIII in FIG. 7, the signal-joining terminal portion 20 extends concretely from the base part 23 of the body portion 15.

Figure 9:
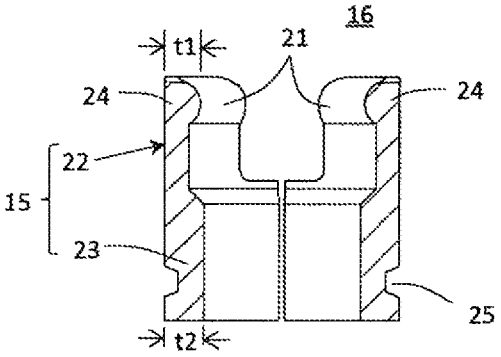
FIG. 9 is a schematic cross-sectional view showing a cross section taken along line IX-IX in FIG. 7.

As shown in FIG. 9 showing a cross section taken along line IX-IX in FIG. 7, in the body portion 15 of the signal-joining contacting conductor 16, a measure of thickness t1 of each of the resilient contacting curved plates 24 including the contacting protrusion 21, which constitutes the press-contacting part 22, is determined to be less than or equal to the maximum measure of thickness t2 of the base part 23. That is, the measure of thickness t1 of the press-contacting part 22 including the contacting protrusion 21 of the body portion 15 is determined to be less than or equal to the maximum measure of thickness t2 of the base part 23 of the body portion 15.

Figure 10:
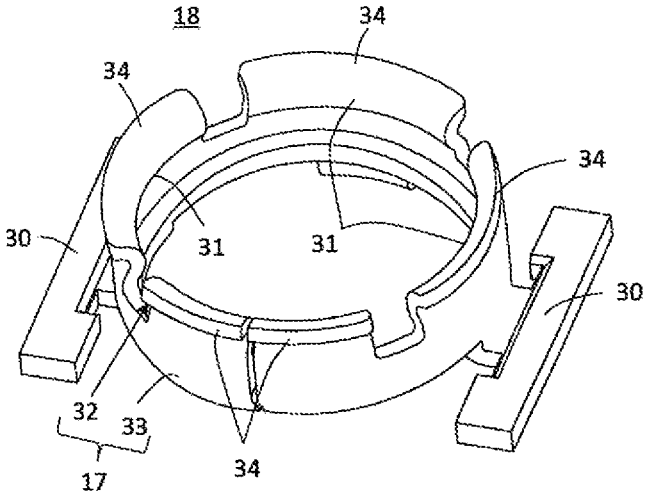
FIG. 10 is a schematic perspective view showing a grounding contacting conductor provided to be employed in the embodiment of electrical coaxial connector according to the present invention.
Figure 11:
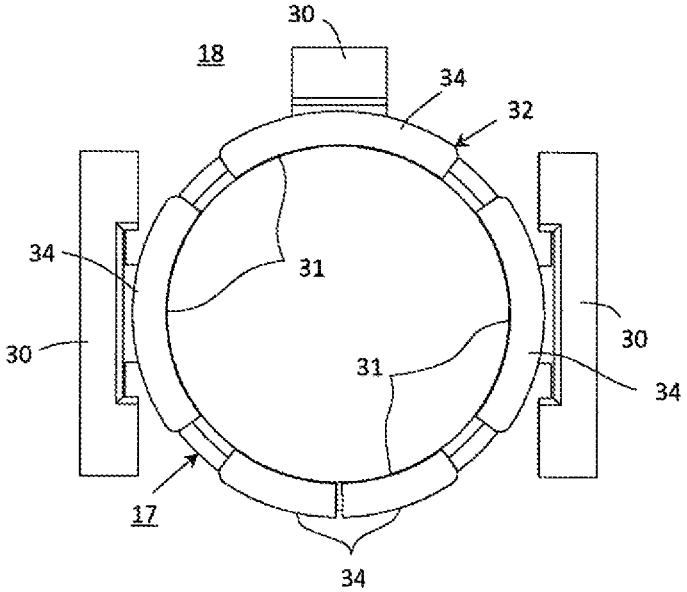
FIG. 11 is a schematic plan view showing a grounding contacting conductor provided to be employed in the embodiment of electrical coaxial connector according to the present invention.

The grounding contacting conductor 18 is made of, for example, resilient conductive material such as a metal plate in the same manner as the signal-joining contacting conductor 16 to have, in addition to the annular portion 17, a plurality of grounding terminal portions 30 each extending from an end of the annular portion 17 to the outside of the flat board portion 13 of the insulating base member 12, as shown in FIGS. 10 and 11. The end of the annular portion 17 from which each of the grounding terminal portions 30 extends and the grounding terminal portions 30 are partially buried in the flat board portion 13 of the insulating base member 12. Each of the grounding terminal portions 30 is provided to be connected with a grounding terminal provided on the circuit board on which the insulating base member 12 is put.

The annular portion 17 of the grounding contacting conductor 18 is formed into a cylindrical shape to have an engaging part 32 provided thereon with an engaging protrusion 31 for coming into engagement with the grounding conductor in the mating coaxial connector and a base part 33 extending from the engaging part 32 to be buried in the flat board portion 13 of the insulating base member 12.

The engaging part 32 of the annular portion 17 comprises a plurality of, for example, four resilient engaging curved plates 34 arranged to surround the imaginary central axis of the cylindrical shape of the annular portion 17 with a space between each two adjoin each other. Each of the resilient engaging curved plates 34 is provided thereon with the engaging protrusion 31 projecting to the inside of the annular portion 17 formed into the cylindrical shape.

The base part 33 of the annular portion 17 includes an end of the annular portion 17 from which each of the grounding terminal portions 30 extends. Therefore, as shown clearly in FIG. 10, each of the grounding terminal portions 30 extends concretely from the base part 33 of the annular portion 17.

As shown in FIG. 4, in the annular portion 17 of the grounding contacting conductor 18, a measure of thickness u1 of each of the resilient engaging curved plates 34 including the engaging protrusion 31, which constitutes the engaging part 32, is determined to be less than or equal to the maximum measure of thickness u2 of the base part 33. That is, the measure of thickness t1 of the engaging part 32 including the engaging protrusion 31 of the annular portion 17 is determined to be less than or equal to the maximum measure of thickness u2 of the base part 33 of the annular portion 17.

In a manufacturing process of the electrical coaxial connector 11 comprising the signal-joining contacting conductor 16, the grounding contacting conductor 18 and the insulating base member 12 supporting the signal-joining contacting conductor 16 and the grounding contacting conductor 18 to be isolated from each other as described above, the signal-joining contacting conductor 16 and the grounding contacting conductor 18 are incorporated with the insulating base member 12 by means of, for example, an insert molding using a mold structure. When such an insert molding using the mold structure is carried out, first, the signal-joining contacting conductor 16 and the grounding contacting conductor 18 are arranged in such a manner as shown in FIG. 12 to be placed in the mold structure.

Figure 12:
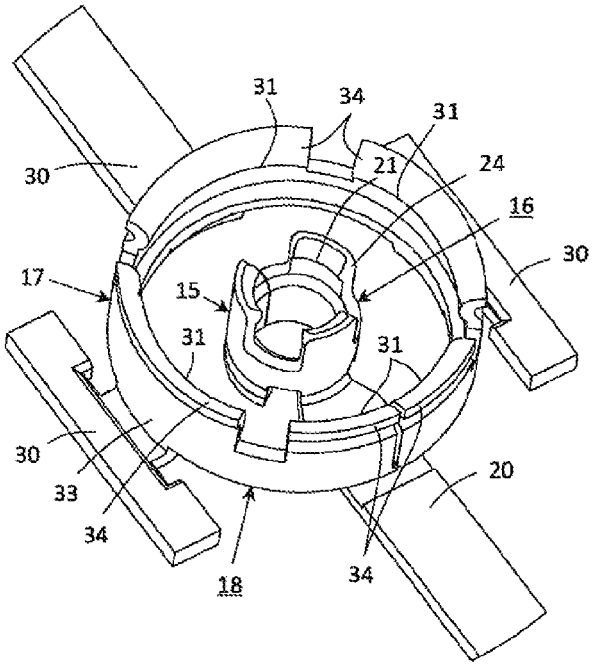
FIG. 12 is a schematic perspective view used for explaining one of steps in a manufacturing process of the embodiment of electrical coaxial connector according to the present invention.

In FIG. 12, the imaginary central axis of the cylindrical shape of the body portion 15 of the signal-joining contacting conductor 16 is positioned to coincide with the imaginary central axis of the cylindrical shape of the annular portion 17 of the grounding contacting conductor 18, and the body portion 15 of the signal-joining contacting conductor 16 is put between the signal-joining terminal portion 20 of the signal-joining contacting conductor 16 and one of the grounding terminal portions 30 of the grounding contacting conductor 18 which are opposite to each other. Each of the signal-joining terminal portion 20 of the signal-joining contacting conductor 16 and said one of the grounding terminal portions 30 of the grounding contacting conductor 18 shown in FIG. 12 has not been subjected to a finishing step of cutting process.

Figure 13:
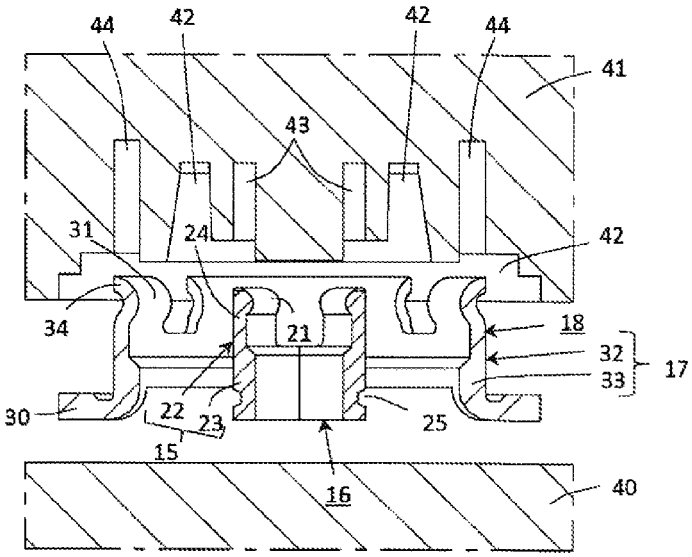
FIG. 13 is a schematic cross-sectional view used for explaining one of steps in the manufacturing process of the embodiment of electrical coaxial connector according to the present invention.

As shown in FIG. 13, the signal-joining contacting conductor 16 and the grounding contacting conductor 18 arranged as shown in FIG. 12 are put between a lower mold 40 and an upper mold 41 constituting the mold structure. The upper mold 41 is provided therein with a molding cavity 42 into which synthetic resin material is to be put, a first receiving cavity 43 for accommodating the press-contacting part 22 of the body portion 15 of the signal-joining contacting conductor 16, and a second receiving cavity 44 for accommodating the engaging part 32 of the annular portion 17 of the grounding contacting conductor 18. Each of the molding cavity 42, the first receiving cavity 43 and the second receiving cavity 44 faces the lower mold 40.

Figure 14:
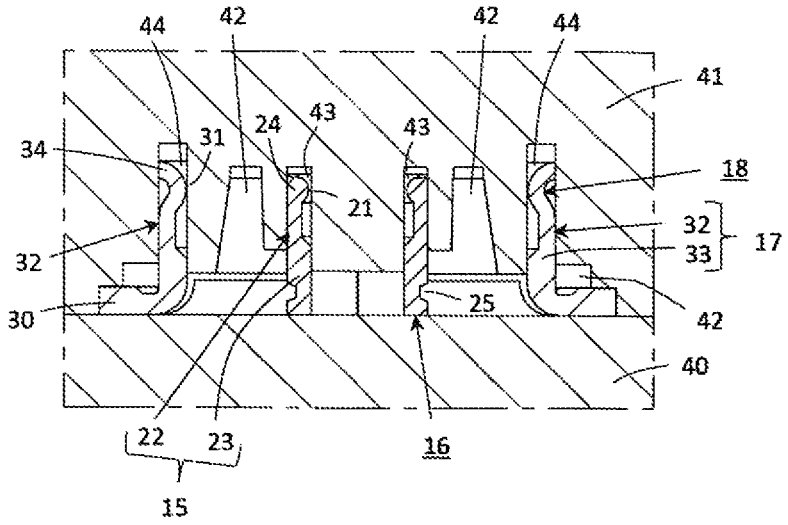
FIG. 14 is a schematic cross-sectional view used for explaining one of steps in the manufacturing process of the embodiment of electrical coaxial connector according to the present invention.

Next, as shown in FIG. 14, the lower mold 40 and the upper mold 41 are caused to come close to each other so that the upper mold 41 comes into contact closely with the lower mold 40. On that occasion, each of the resilient contacting curved plates 24 constituting the press-contacting part 22 of the body portion 15 of the signal-joining contacting conductor 16 is accommodated in the first receiving cavity 43 and each of the resilient engaging curved plates 34 constituting the engaging part 32 of the annular portion 17 of the grounding contacting conductor 18 is accommodated in the second receiving cavity 44.

Under such a condition, since the measure of thickness t1 of each of the resilient contacting curved plates 24 including the contacting protrusion 21, which constitutes the press-contacting part 22 of the body portion 15 of the signal-joining contacting conductor 16, is determined to be less than or equal to the maximum measure of thickness t2 of the base part 23 of the body portion 15, the first receiving cavity 43 for accommodating each of the resilient contacting curved plates 24 is able to be formed into a simplified shape having an opening width corresponding to the maximum measure of thickness t2 of the base part 23 of the body portion 15, and since the measure of thickness u1 of each of the resilient engaging curved plates 34 including the engaging protrusion 31, which constitutes the engaging part 32 of the annular portion 17 of the grounding contacting conductor 18, is determined to be less than or equal to the maximum measure of thickness u2 of the base part 33 of the annular portion 17, the second receiving cavity 44 for accommodating each of the resilient engaging curved plates 34 is able to be formed into a simplified shape having an opening width corresponding to the maximum measure of thickness u2 of the base part 33 of the annular portion 17.

Figure 15:
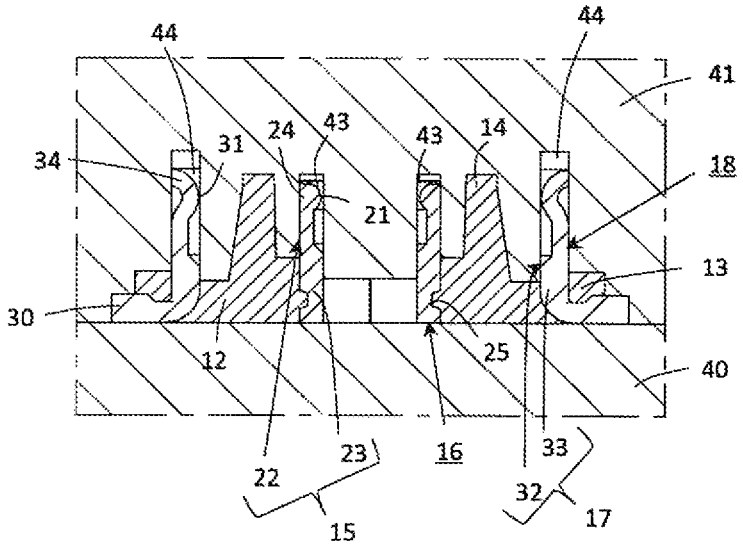
FIG. 15 is a schematic cross-sectional view used for explaining one of steps in the manufacturing process of the embodiment of electrical coaxial connector according to the present invention.

Then, as shown in FIG. 15, the insert molding in which the synthetic resin material is put into the molding cavity 42 provided in the upper mold 41 is carried out, so that the insulating base member 12 made of insulator such as plastics or the like is obtained when the synthetic resin material put into the molding cavity 42 has been solidified. In the insulating base member 12 thus obtained, the base part 23 of the body portion 15 and the part of the signal-joining terminal portion 20 of the signal-joining contacting conductor 16 and the base part 33 of the annular portion 17 and the part of the grounding terminal portion 30 of the grounding contacting conductor 18 are buried in the flat board portion 13 and the annular projection 14 is formed at the central part of the flat board portion 13. Accordingly, the signal-joining contacting conductor 16 and the grounding contacting conductor 18 are incorporated with the insulating base member 12 by means of the insert molding using the mold structure including the lower mold 40 and the upper mold 41.

Figure 16:
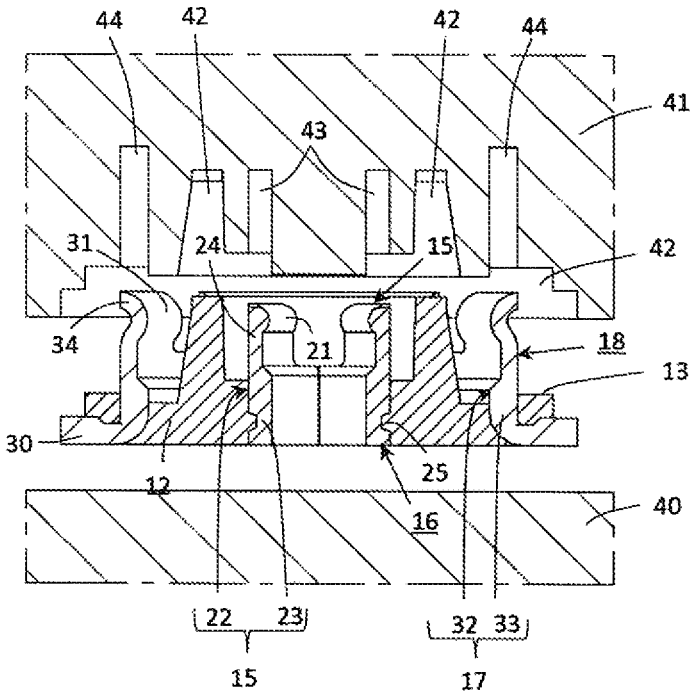
FIG. 16 is a schematic cross-sectional view used for explaining one of steps in the manufacturing process of the embodiment of electrical coaxial connector according to the present invention.
Figure 17:
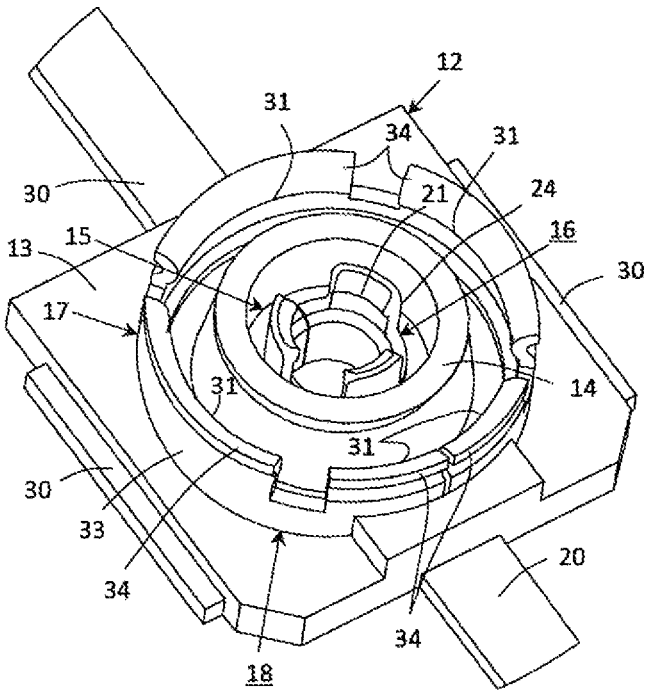
FIG. 17 is a schematic perspective view used for explaining one of steps in the manufacturing process of the embodiment of electrical coaxial connector according to the present invention.

After that, as shown in FIG. 16, the upper mold 41 is separated from the lower mold 40, and the electrical coaxial connector 11 having the insulating base member 12 with which the signal-joining contacting conductor 16 and the grounding contacting conductor 18 are incorporated by means of the insert molding is taken out from a space between the lower mold 40 and the upper mold 41, as shown in FIG. 17. Although, in the electrical coaxial connector 11 shown in FIG. 17, each of the signal-joining terminal portion 20 of the signal-joining contacting conductor 16 and one of the grounding terminal portions 30 of the grounding contacting conductor 18 has not been subjected to the finishing step of the cutting process, the electrical coaxial connector 11 shown in FIG. 1 is obtained when each of the signal-joining terminal portion 20 of the signal-joining contacting conductor 16 and said one of the grounding terminal portions 30 of the grounding contacting conductor 18 is subjected to the finishing step of the cutting process.

In the electrical coaxial connector 11 shown in FIG. 1, the signal-joining terminal portion 20 extends from the flat board portion 13 of the insulating base member 12 to the outside of the insulating base member 12 to be connected with the signal terminal provided on the circuit board on which the insulating base member 12 is put. In addition, the press-contacting part 22 of the body portion 15 of the signal-joining contacting conductor 16 projects upward from the flat board portion 13 of the insulating base member 12 at the inside of the annular projection 14 of the insulating base member 12 for engaging with the signal-joining conductor in the mating coaxial connector inserted in the inside of the resilient contacting curved plates 24 constituting the press-contacting part 22 so as to cause the contacting protrusion 21 provided on each of the resilient contacting curved plates 24 to come into contact with the signal-joining conductor in the mating coaxial connector. Thereby, the signal-joining contacting conductor 16 is electrically connected with the signal-joining conductor in the mating coaxial connector.

Further, in the electrical coaxial connector 11 shown in FIG. 1, each of the grounding terminal portions 30 extends from the flat board portion 13 of the insulating base member 12 to the outside of the insulating base member 12 to be connected with the grounding terminal provided on the circuit board on which the insulating base member 12 is put. In addition, the engaging part 32 of the annular portion 17 of the grounding contacting conductor 18 projects upward from the flat board portion 13 of the insulating base member 12 at the outside of the annular projection 14 of the insulating base member 12 for engaging with the grounding conductor in the mating coaxial connector inserted in the inside of the resilient engaging curved plates 34 constituting the engaging part 32 so as to cause the engaging protrusion 31 provided on each of the resilient engaging curved plates 34 to come into engagement with the grounding conductor in the mating coaxial connector. Thereby, the grounding contacting conductor 18 is electrically connected with the grounding conductor in the mating coaxial connector.

When the electrical coaxial connector 11 is coupled with the mating coaxial connector, the electrical coaxial connector 11 is first positioned to cause each of a ring-shaped end of the annular projection 14 of the insulating base member 12, a ring-shaped end of the body portion 15 of the signal-joining contacting conductor 16 supported by the insulating base member 12 and a ring-shaped end of the annular portion 17 of the grounding contacting conductor 18 supported by the insulating base member 12 to face the mating coaxial connector, and then caused to come close to the mating coaxial connector. The mating coaxial connector in such a case is constituted with, for example, a mating coaxial connector 51 shown in FIGS. 18 and 19.

Figure 18:
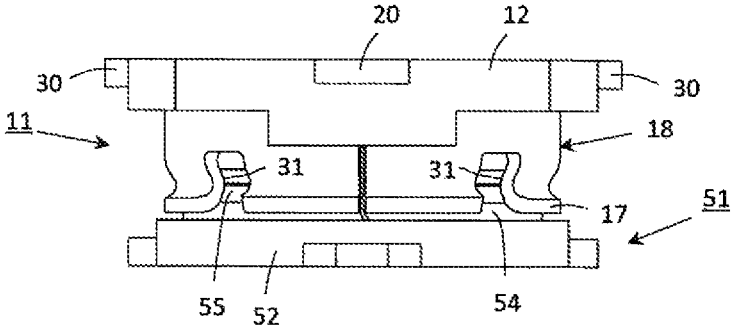
FIG. 18 is a schematic front view showing the embodiment of electrical coaxial connector according to the present invention coupled with the mating coaxial connector.
Figure 19:
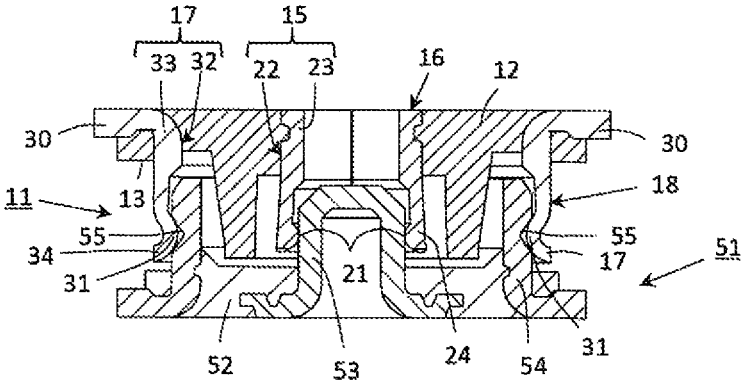
FIG. 19 is a schematic cross-sectional view showing the embodiment of electrical coaxial connector according to the present invention coupled with the mating coaxial connector.

In FIGS. 18 and 19, the mating coaxial connector 51 comprises an insulating base member 52 made of insulator such as plastics or the like to be put on a circuit board on which the mating coaxial connector 51 is mounted, a signal-joining conductor 53 formed into a column to stand at a central portion of the insulating base member 52 and a grounding conductor 54 formed into an annular shape to be supported by the insulating base member 52 for surrounding the signal-joining conductor 53. The signal-joining conductor 53 is connected with the signal terminal provided on the circuit board on which the insulating base member 52 is put and the grounding conductor 54 is connected with the grounding terminal provided on the circuit board on which the insulating base member 52 is put.

Under a condition wherein the electrical coaxial connector 11 is coupled with the mating coaxial connector 51, as shown in FIGS. 18 and 19, the press-contacting part 22 of the body portion 15 of the signal-joining contacting conductor 16 in the electrical coaxial connector 11 engages with the signal-joining conductor 53 in the mating coaxial connector 51 inserted in the inside of the resilient contacting curved plates 24 constituting the press-contacting part 22 and the engaging part 32 of the annular portion 17 of the grounding contacting conductor 18 in the electrical coaxial connector 11 engages with the grounding conductor 54 in the mating coaxial connector 51 inserted in the inside of the resilient engaging curved plates 34 constituting the engaging part 32.

When the press-contacting part 22 of the body portion 15 of the signal-joining contacting conductor 16 in the electrical coaxial connector 11 engages with the signal-joining conductor 53 in the mating coaxial connector 51, the contacting protrusion 21 provided on each of the resilient contacting curved plates 24 is caused to come into contact with an outer surface of the signal-joining conductor 53 in the mating coaxial connector 51. Thereby, the contacting protrusion 21 provided on each of the resilient contacting curved plates 24 is operative to exert relatively large resilient pressure on the signal-joining conductor 53 in the mating coaxial connector 51. As a result, the signal-joining contacting conductor 16 in the electrical coaxial connector 11 is electrically connected with the signal-joining conductor 53 in the mating coaxial connector 51 with the relatively large resilient pressure exerted on the signal-joining conductor 53, so that a condition wherein the signal-joining contacting conductor 16 in the electrical coaxial connector 11 is properly and surely connected with the signal-joining conductor 53 in the mating coaxial connector 51 is stably maintained.

When the engaging part 32 of the annular portion 17 of the grounding contacting conductor 18 in the electrical coaxial connector 11 engages with the grounding conductor 54 in the mating coaxial connector 51, the engaging protrusion 31 provided on each of the resilient engaging curved plates 34 is caused to come into engagement with a circular groove 55 provided on an outer surface of the grounding conductor 54 in the mating coaxial connector 51. Thereby, the engaging protrusion 31 provided on each of the resilient engaging curved plates 34 is operative to exert relatively large resilient pressure on the grounding conductor 54 in the mating coaxial connector 51. As a result, the grounding contacting conductor 18 in the electrical coaxial connector 11 is electrically connected with the grounding conductor 54 in the mating coaxial connector 51 with the relatively large resilient pressure exerted on the grounding conductor 54, so that a condition wherein the grounding contacting conductor 18 in the electrical coaxial connector 11 is properly and surely connected with the grounding conductor 54 in the mating coaxial connector 51 is stably maintained.

In the electrical coaxial connector 11 thus constituted in accordance with the present invention, the body portion 15 of the signal-joining contacting conductor 16 which is electrically connected with the signal-joining conductor 53 in the mating coaxial connector 51 when the electrical coaxial connector 11 is coupled with the mating coaxial connector 51, has the press-contacting part 22 provided thereon with the contacting protrusion 21 for coming into contact with the signal-joining conductor 53 in the mating coaxial connector 51 and the base part 23 extending from the press-contacting part 22 to be buried in the insulating base member 12, wherein the measure of thickness t1 of the press-contacting part 22 including the contacting protrusion 21 is less than or equal to the maximum measure of thickness t2 of the base part 23, and the annular portion 17 of the grounding contacting conductor 18 which is electrically connected with the grounding conductor 54 in the mating coaxial connector 51 when the electrical coaxial connector 11 is coupled with the mating coaxial connector 51, has the engaging part 32 provided thereon the engaging protrusion 31 for coming into engagement with the grounding conductor 54 in the mating coaxial connector 51 and the base part 33 extending from the engaging part 32 to be buried in the insulating base member 12, wherein the measure of thickness u1 of the engaging part 32 including the engaging protrusion 31 is less than or equal to the maximum measure of thickness u2 of the base part 33.

With the body portion 15 of the signal-joining contacting conductor 16 in which the measure of thickness t1 of the press-contacting part 22 including the contacting protrusion 21 is determined to be less than or equal to the maximum measure of thickness t2 of the base part 23 and the annular portion 17 of the grounding contacting conductor 18 in which the measure of thickness u1 of the engaging part 32 including the engaging protrusion 31 is determined to be less than or equal to the maximum measure of thickness u2 of the base part 33, the insert molding for incorporating the signal-joining contacting conductor 16 and the grounding contacting conductor 18 with the insulating base member 12 operative to support the signal-joining contacting conductor 16 and the grounding contacting conductor 18 to be isolated from each other is able to be carried out with a simplified mold structure including, for example, the lower mold 40 and the upper mold 41 without bringing about a situation wherein the insulating base member 12 with which the signal-joining contacting conductor 16 and the grounding contacting conductor 18 have been incorporated is obstructed to be removed from the mold structure after the insert molding. By means of such an insert molding, for example, the base part 23 of the body portion 15 and the part of the signal-joining terminal portion 20 of the signal-joining contacting conductor 16 and the base part 33 of the annular portion 17 and the part of the grounding terminal portion 30 of the grounding contacting conductor 18 are incorporated with the insulating base member 12.

Accordingly, with the electrical coaxial connector 11, the signal-joining contacting conductor 16 and the grounding contacting conductor 18 are able to be incorporated with the insulating base member 12 by means of the insert molding with the simplified mold structure including, for example, the lower mold 40 and the upper mold 41 and thereby assembling time and labor are able to be reduced and accuracy in assembly is able to be improved in the manufacturing of the electrical coaxial connector 11, so that manufacturing cost of the electrical coaxial connector 11 is able to be effectively reduced.

Further, in the electrical coaxial connector 11, under a condition wherein the body portion 15 of the signal-joining contacting conductor 16 is formed into the cylindrical shape so that the contacting protrusion 21 provided on the press-contacting part 22 of the body portion 15 projects to the inside of the body portion 15 and the engaging protrusion 31 provided on the engaging part 32 of the annular portion 17 of the grounding contacting conductor 18 projects to the inside of the annular portion 17, when the signal-joining conductor 53 in the mating coaxial connector 51 is inserted into the body portion 15 of the signal-joining contacting conductor 16, the contacting protrusion 21 provided on the press-contacting part 22 of the body portion 15 comes into contact with the signal-joining conductor 53 in the mating coaxial connector 51 so that the body portion 15 of the signal-joining contacting conductor 16 is electrically connected with the signal-joining conductor 53 in the mating coaxial connector 51, and when the grounding conductor 54 in the mating coaxial connector 51 is inserted into the annular portion 17 of the grounding contacting conductor 18, the engaging protrusion 31 provided on the engaging part 32 of the annular portion 17 comes into engagement with the grounding conductor 54 in the mating coaxial connector 51 so that the annular portion 17 of the grounding contacting conductor 18 is electrically connected with the grounding conductor 54 in the mating coaxial connector 51. Consequently, a condition wherein the body portion 15 of the signal-joining contacting conductor 16 is properly connected with the signal-joining conductor 53 in the mating coaxial connector 51 and the annular portion 17 of the grounding contacting conductor 18 is properly connected with the grounding conductor 54 in the mating coaxial connector 51 is stably maintained.

The invention claimed is:

1. An electrical coaxial connector comprising;

a signal-joining contacting conductor having a body portion provided to be electrically connected with a signal-joining conductor in a mating coaxial connector and a signal-joining terminal portion extending from the body portion, a grounding contacting conductor having an annular portion placed around the body portion of the signal-joining contacting conductor to be electrically connected with a grounding conductor in the mating coaxial connector and a grounding terminal portion extending from the annular portion, and an insulating base member in which each of the signal-joining terminal portion of the signal-joining contacting conductor and the grounding terminal portion of the grounding contacting conductor is partially buried and which supports the signal-joining contacting conductor and the grounding contacting conductor to be isolated from each other, wherein the body portion of the signal-joining contacting conductor has a press-contacting part provided thereon with a contacting protrusion for coming into press-contact with the signal-joining conductor in the mating coaxial connector and a first base part extending from the press-contacting part to be buried in the insulating base member in such a manner that a measure of thickness of the press-contacting part including the contacting protrusion is less than or equal to the maximum measure of thickness of the first base part, and the annular portion of the grounding contacting conductor has an engaging part provided thereon with an engaging protrusion for coming into engagement with the grounding conductor in the mating coaxial connector and a second base part extending from the engaging part to be buried in the insulating base member in such a manner that a measure of thickness of the engaging part including the engaging protrusion is less than or equal to the maximum measure of thickness of the second base part.

2. An electrical coaxial connector according to claim 1, wherein the first base part of the body portion of the signal-joining contacting conductor is provided thereon with a groove in which a part of the insulating base member is inserted.

3. An electrical coaxial connector according to claim 1, wherein the signal-joining terminal portion of the signal-joining contacting conductor extends from the first base part of the body portion of the signal-joining contacting conductor and the grounding terminal portion of the grounding contacting conductor extends from the second base part of the annular portion of the grounding contacting conductor.

4. An electrical coaxial connector according to claim 1, wherein the body portion of the signal-joining contacting conductor is formed into a cylindrical shape so that the contacting protrusion provided on the press-contacting part of the body portion formed into the cylindrical shape projects to the inside of the body portion and the engaging protrusion provided on the engaging part of the annular portion of the grounding contacting conductor projects to the inside of the annular portion.

5. An electrical coaxial connector according to claim 4, wherein the press-contacting part of the body portion of the signal-joining contacting conductor comprises a plurality of resilient contacting curved plates arranged circular with a space between each two adjoin each other and the contacting protrusion is provided on each of the resilient contacting curved plates.

6. An electrical coaxial connector according to claim 4, wherein the engaging part of the annular portion of the grounding contacting conductor comprises a plurality of resilient engaging curved plates arranged circular with a space between each two adjoin each other and the engaging protrusion is provided on each of the resilient engaging curved plates.

7. An electrical coaxial connector according to claim 1, wherein the first base part of the body portion and a part of the signal-joining terminal portion of the signal-joining contacting conductor and the second base part of the annular portion and a part of the grounding terminal portion of the grounding contacting conductor are incorporated with the insulating base member by means of insert molding.

* * * * *